US007311458B2

(12) United States Patent
Verlin

(10) Patent No.: US 7,311,458 B2
(45) Date of Patent: Dec. 25, 2007

(54) SQUEEGEE

(76) Inventor: Stephen J. Verlin, 7778 Oak Grove Cir., Lake Worth, FL (US) 33467

( * ) Notice: Subject to any disclaimer, the term of this patent is extended or adjusted under 35 U.S.C. 154(b) by 363 days.

(21) Appl. No.: 11/000,753

(22) Filed: Dec. 1, 2004

(65) Prior Publication Data

US 2006/0115316 A1 Jun. 1, 2006

(51) Int. Cl.
*A45D 33/00* (2006.01)

(52) U.S. Cl. ..... 401/130; 401/38; 401/39

(58) Field of Classification Search ..... 401/126–130, 401/262, 38, 39; 15/244.2, 111, 244.1, 117, 15/144.1, 172, 144.4, 121, 236.02, 245
See application file for complete search history.

(56) References Cited

U.S. PATENT DOCUMENTS

| | | | | |
|---|---|---|---|---|
| 207,256 | A | 8/1878 | Crane | |
| 1,246,956 | A | 11/1917 | Lerch | |
| 1,260,258 | A | 3/1918 | Doolittle | |
| 1,838,158 | A | 12/1931 | Schwartz | |
| 2,280,165 | A | 4/1942 | Sebastian | |
| 4,192,360 | A * | 3/1980 | Rodriquez | 141/24 |
| 4,200,949 | A * | 5/1980 | Heniff, Jr. | 15/257.6 |
| 4,302,862 | A | 12/1981 | Machacek et al. | |
| D269,642 | S | 7/1983 | Sommers | |
| 4,776,716 | A | 10/1988 | Huang | |
| 4,903,869 | A | 2/1990 | McKenna | |
| 4,908,900 | A | 3/1990 | McLaughlin et al. | |
| 5,076,478 | A | 12/1991 | Unger | |
| 5,946,762 | A | 9/1999 | Dionisio | |
| 6,036,388 | A | 3/2000 | Atcher | |
| 6,050,273 | A * | 4/2000 | Lhuisset | 132/317 |
| 6,227,737 | B1 * | 5/2001 | Lightfoot | 401/129 |
| 6,301,740 | B1 * | 10/2001 | Quiroz | 15/172 |
| 6,481,041 | B1 | 11/2002 | Ingram | |
| 6,758,331 | B2 | 7/2004 | DeHart | |
| 6,854,910 | B2 * | 2/2005 | Leblanc | 401/118 |
| 6,990,705 | B1 * | 1/2006 | Schouten et al. | 15/111 |
| 2002/0078521 | A1 | 6/2002 | Ohm | |
| 2003/0037390 | A1 * | 2/2003 | Leblanc | 15/121 |
| 2005/0180807 | A1 * | 8/2005 | Walsh | 401/131 |
| 2006/0029458 | A1 * | 2/2006 | Jones | 401/129 |
| 2007/0044264 | A1 * | 3/2007 | Argo et al. | 15/245 |

* cited by examiner

*Primary Examiner*—Khoa D. Huynh
(74) *Attorney, Agent, or Firm*—Christopher & Weisberg, P.A.

(57) ABSTRACT

A squeegee apparatus having an elongated handle with a first end, a second end, and a sealing element between the first end and the second end. The apparatus also includes a cleaning member moveable with respect to the handle from a first position, where a longitudinal axis of the cleaning member is substantially parallel to the axis of the handle, to a second position, where the longitudinal axis of the cleaning member is substantially perpendicular to the axis of the handle, and a container defining a reservoir for a cleaning solution, the container further defining an opening that is adapted to receive the cleaning member within the container and to be sealed by the sealing element on the elongate handle. The container further provides a hollow structure adapted to house at least a portion of the handle and the cleaning member when in the first position, the structure being aligned with and subjacent to the opening in the container and having one or more apertures.

8 Claims, 3 Drawing Sheets

SQUEEGEE

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates to a squeegee.

BACKGROUND OF THE INVENTION

Automotive safety is an area of concern to legislators, auto makers, insurers, and consumers. Considerable attention has been appropriately directed to new and improved devices that help drivers avoid and survive accidents, such as all-wheel drive, anti-lock brakes, seatbelt pretension devices, side-curtain airbags, crumple zones and the like. Of course, each new component or feature often increases vehicle cost, sometimes significantly. While it is natural to focus on exciting new vehicle technologies, safety can also be enhanced in less glamorous and less costly ways, such as basic vehicle maintenance. One example of basic maintenance is proper inflation of the tires. Another example is maintaining clean windows.

As anyone who has driven a vehicle with very dirty windows will attest, what may have appeared to be a mere "nuisance" or irritation at the beginning of a drive, sometimes leads to harrowing circumstances and accidents. Even small spots on glass can have a severe adverse effect on driving conditions by causing a driver to focus in the near field (on the spot), rather than at a distance or infinity (away from the vehicle). For months at a time in northern climates, vehicles windows are splattered with salt, sand, and slush; and at other times of year and in other places, insects are smeared on the windshield. Either way, the result is mildly to severely obstructed vision with a concomitant decrease in safety.

Most cars and truck are equipped with integral window washing systems whereby washer fluid is sprayed onto a windshield while the windshield wipers are activated. Although this type of system is often effective for light grime, a significant area of the windshield is not reached by the windshield wipers. Even the most effective car windshield washer systems are incapable of entirely removing bug impact smears. Further, integrated window washers are almost always limited to the front windshield and occasionally the rear windows.

By contrast with an automobile's integral window washers, a squeegee with a scrubbing sponge and cleaning solution can remove almost any grime or bug and the squeegee can be used to quickly clean all the vehicle's windows. Drivers, however, do not typically carry squeegees with them on the road. Instead, squeegees are found at some gas stations where they are stored in an upright, open container that is hopefully filled with a cleaning solution.

Thus, other than at gas stations, which are typically only visited once or twice a week, squeegees are rarely seen. But in some of the above-described conditions, a driver could make use of a squeegee once or twice a day, or even more frequently. Although it would be desirable to have the benefits of a squeegee away from a gas station, there are certain difficulties that arise when away from the station. For example, because a squeegee is most effective when it includes a relatively long handle for cleaning large or difficult to reach window portions, the squeegee must be stored in a large enough container to house both the squeegee sponge and the elongated handle. If the container is used a reservoir for cleaning solution, it must be maintained upright, sealed, or filled and emptied upon use. A squeegee and cleaning solution container combination such as found in gas stations is clearly too bulky and cumbersome to be desirable for in-vehicle carriage. Thus, for a large number of drivers, it would be desirable and advantageous to have a compact squeegee with a leak resistant cleaning solution reservoir that is easily stored and transported in a vehicle.

SUMMARY OF THE INVENTION

The present invention provides a compact squeegee that is housed within a compact, leak resistant cleaning solution reservoir. In an exemplary embodiment the squeegee has an elongate handle with a cleaning member moveable with respect to the handle from a first position, wherein the longitudinal axis of the cleaning member is parallel to the axis of the handle, to a second position wherein the longitudinal axis of the cleaning member is perpendicular to the axis of the handle. The squeegee further includes a container with a lid for containing a liquid such as window cleaning solution. The lid can be integrated with the handle of the cleaning member, or have an aperture allowing a portion of the handle to project through when the cleaning member is placed in the container and the container is subsequently sealed. A hollow cylindrical structure can be located within the container to receive at least a portion of the cleaning member.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
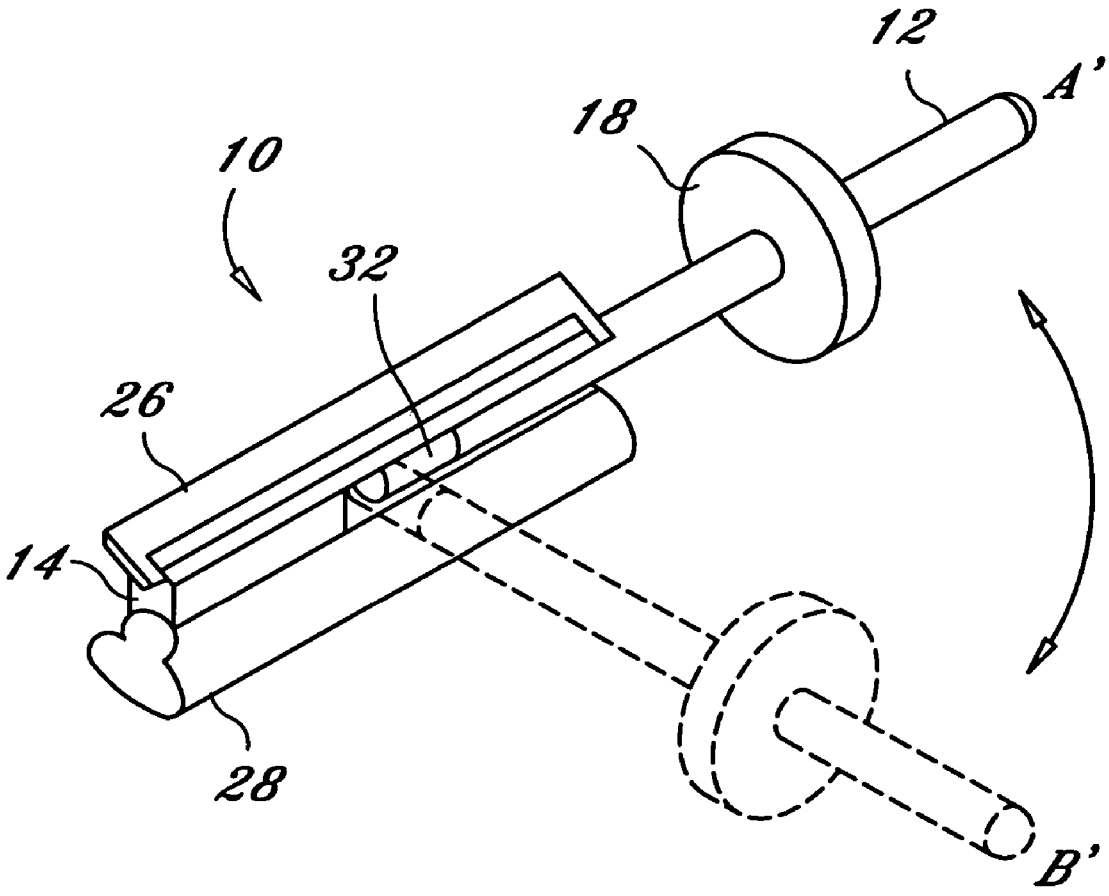
FIG. 1 shows an embodiment of a squeegee apparatus in accordance with the present invention.

Referring to FIG. 1, in an exemplary embodiment, the present invention provides a squeegee apparatus 10 including an elongated handle 12 having a first end and a second end. The squeegee apparatus also includes a cleaning member 14 coupled to the handle 12 that is moveable with respect to the handle 12 from a first position A' where the longitudinal axis of the cleaning member is substantially parallel to the axis of the handle to a second position B' where the longitudinal axis of the cleaning member is substantially perpendicular to the axis of the handle. The first position orients the cleaning member 14 and the handle 12 into a compact, easily portable configuration, while the cleaning member 14 can then be moved into the second position for general use. The cleaning member 14 of the squeegee apparatus 10 can include a sponge 28, which allows for the application of cleaning fluid to a dirty surface, as well as a blade 26 for wiping away the excess fluid and dirt from a surface.

Additionally, the cleaning member 14 can be affixed to the handle through the use of a clamping member 32 which is pivotally mounted to the second end of the handle, where the clamping member is pivotable about an axis perpendicular to the longitudinal axis of the handle 12. The clamping member 32 allows for the movement of the cleaning member 14 about the handle 12 from the first position for storage to the second position for use. Further, the pivoting movement of the handle about the cleaning member can be biased towards either the first or second position. For example, the position of the cleaning member 14 may include a spring mechanism between the handle 12 and the cleaning member 14 that predisposes the squeegee apparatus 10 to move into the second position with little externally applied force by a user. Moreover, the squeegee apparatus 10 can include a locking mechanism that aids in preventing the squeegee handle 12 from pivoting about the cleaning member when in us. For example, the locking mechanism may require an increased effort in order to move the squeegee apparatus from the second position while in use to the first position for storage.

Figure 2:
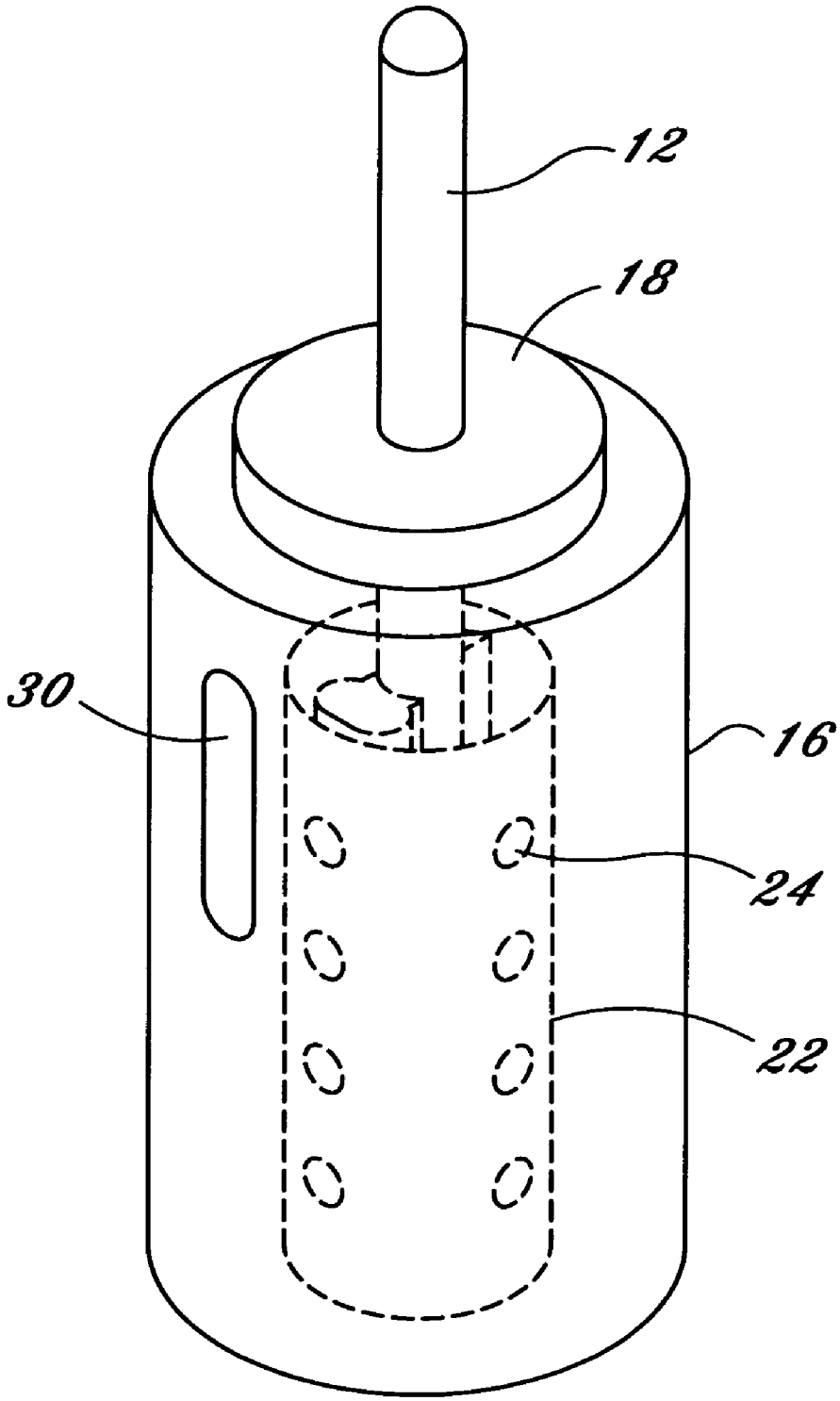
FIG. 2 illustrates a container and the features thereof in accordance with the present invention.

Now referring to FIG. 2, a container 16 is also provided that defines a reservoir for a cleaning solution while also having an opening adapted to receive at least a portion of the cleaning member 14 and the handle 12. The container 16 may be of any suitable shape in order to receive a portion of the squeegee apparatus 10, whether cylindrical, rectangular, or the like. Further, the width of the container 16 is narrower than the length of the cleaning member 14, as to only accommodate a portion of the squeegee apparatus 10 when in the first position. The narrow dimensions of the container 16 increase the portability and ease of storage of the squeegee apparatus 10 when not in use as compared to a conventional container dimensioned to house the full length of the cleaning member in a horizontal disposition, perpendicular to a handle extending above a water line. The width of the container 16 may be increased as necessary in order to accommodate larger volumes of cleaning solution, which will allow the use of the squeegee apparatus 10 multiple times prior to changing the cleaning solution in the container. The container 16 can also have a carrying handle 30, which eases transport of the container.

Moreover, a lid 18 is provided to seal the container 16 and prevent any cleaning solution from spilling out of the container 10. The lid 18 can include a threaded inner lip which mates with and seals the opening of the container, or, alternatively may form a compression seal in simply sliding over the edges of the opening of the container. The lid 18 may be integrated with and permanently coupled to the handle 12 such that when the squeegee apparatus is placed inside the container, the lid is positioned at a location on the handle 12 that allows the lid 18 to mate with and seal the container 16. The coupling of the lid 18 and the handle 12 allows for ease of removal of the both the handle 12 and the lid 18 from the container 16, and also reduces the likelihood of the lid 18 being lost or dropped when the squeegee apparatus 10 is being used. Alternatively, the lid 18 may have an aperture that allows the lid 18 to slide along a portion of the handle 12 protruding from the container subsequent to the cleaning member 14 and handle 12 being placed into the container, also allowing the lid 18 to move into a position to seal the container with the cleaning member 14, a portion of the handle 12 and any fluid located inside.

A hollow structure 22 is located within the container 16 such that it is aligned with and subjacent to the opening in the container 16, and is further adapted to receive at least a portion of the handle 12 and the cleaning member 14 when in the first position. The hollow structure 22 can include one ore more fluid apertures 24 which allow liquid to pass through and come into contact with the cleaning member 14 when it is placed in the container, and thus, into the hollow structure 22. Additionally, when the cleaning member 14 and handle 12 are located such that they partially extend from both the hollow structure 22 and the container 16, i.e., when the squeegee apparatus is being removed from the container 16, the hollow structure 22 can act as a support which restrains a portion of the cleaning member 14 while the handle 12 can pivot outward from the cleaning member to prepare the squeegee apparatus 10 for use.

Figure 3:
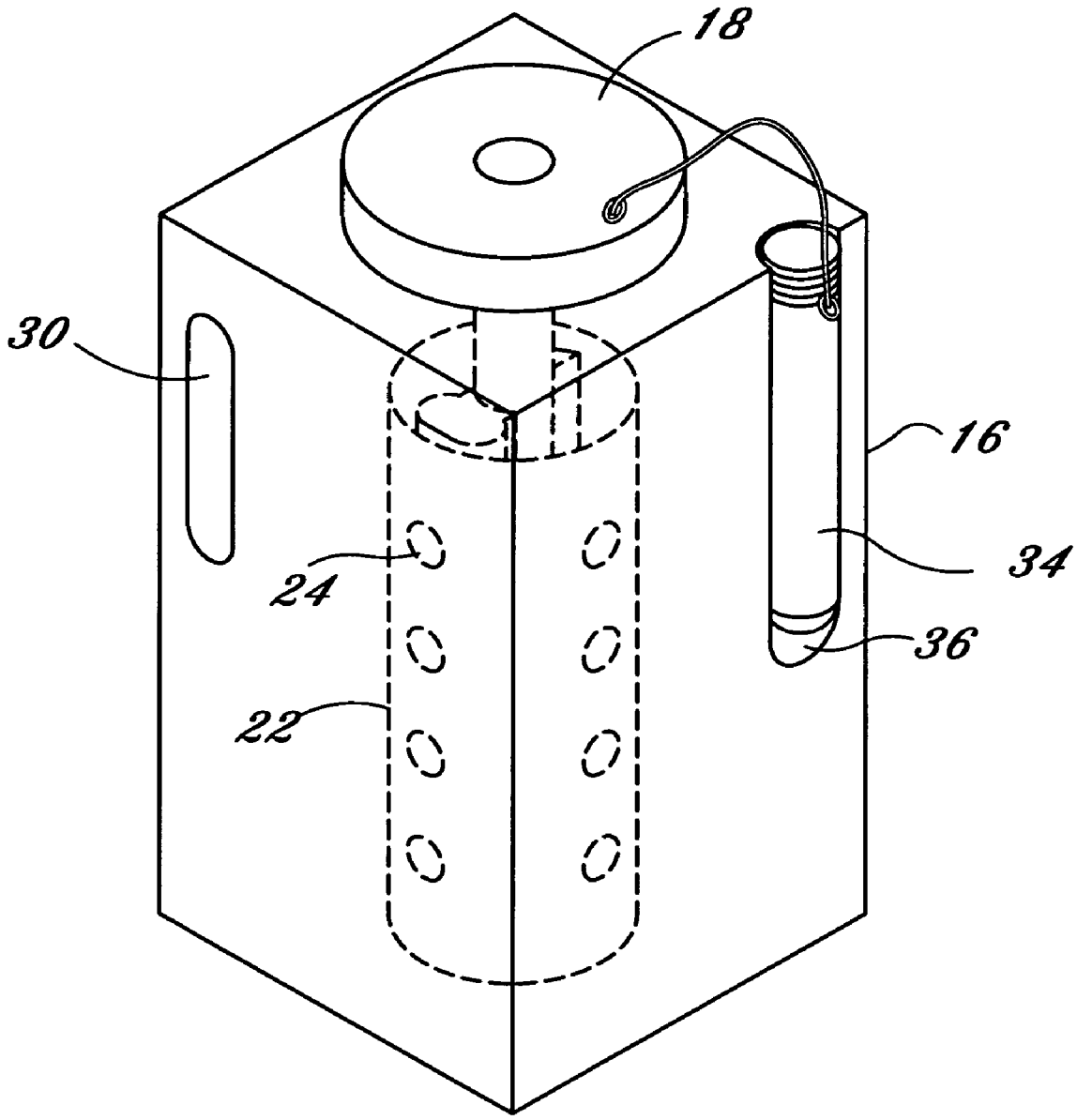
FIG. 3 shows an alternative embodiment of a squeegee apparatus in accordance with the present invention.

An alternative embodiment of the squeegee apparatus 10 includes a handle 12 which is formed by at least two segments which are detachable from one another, as shown in FIG. 3. When the squeegee apparatus 10 is placed inside the container 16 and the lid 18 seals the cleaning member 14 into the container 16, a detachable portion 34 of the handle 12 that protrudes out of both the container 16 and the lid 18 is removable from the portion of the handle 12 contained within the container 16. By uncoupling the detachable portion 34 of the handle 12, the container 16 housing the squeegee apparatus 10 takes up less space, and may be stored in an area slightly larger than the dimensions of the container 16 itself. The detachable portion 34 of the handle 12 may be secured to the lid 18 or the remaining portion of the handle 12 located inside the container 16 by a string or other tethering means in order to prevent the detachable portion 34 of the handle from being lost or misplaced. Additionally, there may be an indentation 36 recessed into the outer surface of the container 16 which is adapted to receive the detachable portion 34 of the handle 12, further reducing the space needed to store the container.

In an exemplary use, the squeegee apparatus 10 is located within the hollow cylindrical structure 22 within the container 16. The squeegee apparatus 10 is in the first position, in which the cleaning member 14 is parallel to the axis of the handle 12. The container 16 is also filled with a cleaning fluid, which flows through the apertures 24 in the hollow cylindrical structure 22 to contact and saturate the sponge 28 of the cleaning member 14. The container 16 is sealed by the lid 18, and a portion of the handle 12 extends beyond both the container 16 and the lid 18. A user then unseals the lid 18 from the container 16, and partially removes the squeegee apparatus 10 from the hollow cylindrical structure 22, and thus the container 16, to a point where the hollow cylindrical structure 22 extends to just below the pivot point where the handle 12 meets the cleaning member 14. The user may then use the hollow cylindrical structure 22 as a support which constrains the cleaning member 14 while pivoting the handle 12 into the second position in anticipation of the use of the squeegee apparatus 10. Upon orienting the squeegee apparatus 10 into the second position, the squeegee apparatus is then completely removed from the container 16, and is used to clean a surface. Should the user need to saturate the sponge 28 with additional cleaning fluid from the container 16, the squeegee apparatus 10 may then be placed back into the container 16 and into the hollow cylindrical structure 22, allowing the absorption of cleaning fluid. When the user has completed the cleaning process, the squeegee apparatus 10 is placed back into the container 16, and the lid 18 is positioned to seal the container 16 until the next use.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A squeegee apparatus comprising:

an elongated handle having a first end, a second end, and a lid between the first end and the second end;

a cleaning member having a sponge and a blade;

the cleaning member being moveable with respect to the elongate handle from a first position, wherein a longitudinal axis of the cleaning member is substantially parallel to a longitudinal axis of the elongate handle, to a second position, wherein the longitudinal axis of the cleaning member is substantially perpendicular to the longitudinal axis of the elongate handle; and a container defining a reservoir for a cleaning solution, the container further defining an opening that is adapted to receive the cleaning member within the container and to be sealed by the lid on the elongate handle, a hollow structure disposed within the container adapted to house at least a portion of the handle and the cleaning member when in the first position, the hollow structure being aligned with and subjacent to the opening in the container, wherein the hollow structure further includes a side wall defining one or more apertures.

2. The squeegee apparatus of claim 1, wherein the container is adapted to receive at least a portion of the handle.

3. The squeegee apparatus of claim 1, wherein at least a portion of the first end of the elongate handle is detachable from the second end and the lid of the elongate handle.

4. The squeegee apparatus of claim 3, wherein the container includes an indentation in an outer surface adapted to receive the detachable portion of the elongate handle.

5. The squeegee apparatus of claim 1, wherein the width of the opening of the container is less than the length of the cleaning element.

6. The squeegee apparatus of claim 1, wherein the width of the container is no greater than one-half of the length of the cleaning element.

7. The squeegee apparatus of claim 1, wherein the container further includes a handle.

8. A squeegee apparatus comprising:

an elongated handle having a first end, a second end, and a lid between the first end and the second end, wherein at least a portion of the first end is detachable from the second end and the lid;

a cleaning member having a sponge and a blade;

the cleaning member being moveable with respect to the handle from a first position, wherein a longitudinal axis of the cleaning member is substantially parallel to a longitudinal axis of the handle, to a second position, wherein the longitudinal axis of the cleaning member is substantially perpendicular to the longitudinal axis of the elongate handle; and a container defining a reservoir for a cleaning solution, wherein the width of the opening of the container is less than the length of the cleaning element, the container further defining an opening that is adapted to receive the cleaning member within the container and to be sealed by the lid on the elongate handle, the container further including a hollow structure disposed within the container adapted to house at least a portion of the handle and the cleaning member when in the first position, the structure being aligned with and subjacent to the opening in the container and including a side wall defining one or more apertures.

* * * * *